US006371129B1

(12) United States Patent
Le Bras-Brown et al.

(10) Patent No.: US 6,371,129 B1
(45) Date of Patent: Apr. 16, 2002

(54) DISPENSER FOR FLUID MATERIALS

(75) Inventors: Robert Nathan Le Bras-Brown, New York, NY (US); Manhar K. Patel, Saddle Brook, NJ (US); Leo Clifford Pires, Basking Ridge, NJ (US); Albert J. Stiso, Jr., Brick, NJ (US); James Joseph Thalheimer, Toms River, NJ (US)

(73) Assignee: Revlon Consumer Products Corporation, New York, NY (US)

( * ) Notice: Subject to any disclaimer, the term of this patent is extended or adjusted under 35 U.S.C. 154(b) by 0 days.

(21) Appl. No.: 09/506,772

(22) Filed: Feb. 18, 2000

(51) Int. Cl.[7] ..... A45D 40/26; B43K 24/02

(52) U.S. Cl. ..... 132/218; 132/74.5; 132/317; 401/108

(58) Field of Search ..... 132/218, 74.5, 132/317, 318; 401/101, 108, 179, 180

(56) References Cited

U.S. PATENT DOCUMENTS

| | | | | | |
|---|---|---|---|---|---|
| 2,195,472 | A | * | 4/1940 | Szucs et al. | 401/108 |
| 2,578,084 | A | * | 12/1951 | Mureau | 132/218 |
| 2,841,157 | A | * | 7/1958 | Walker | 132/317 |
| 2,996,749 | A | | 8/1961 | Hester | |
| 3,320,962 | A | | 5/1967 | Moriber et al. | |
| 3,351,074 | A | | 11/1967 | Aston | |
| 3,358,699 | A | | 12/1967 | Bau | |
| 3,359,992 | A | * | 12/1967 | Cishek et al. | 401/108 |
| 3,612,072 | A | | 10/1971 | Fukui | 132/88.7 |
| 3,613,698 | A | | 10/1971 | Fox | 132/84 |
| 3,630,211 | A | * | 12/1971 | Seidler | 132/317 |
| 3,741,666 | A | | 6/1973 | Vasas et al. | 401/127 |
| 4,367,965 | A | * | 1/1983 | Speitel et al. | 401/108 |
| 4,687,364 | A | | 8/1987 | Kingsford | 401/127 |
| 4,768,529 | A | * | 9/1988 | Mahruki | 132/74.5 |
| 4,838,722 | A | * | 6/1989 | Katz | 401/101 |
| 5,095,580 | A | * | 3/1992 | Capponi | 132/218 |
| 5,109,877 | A | | 5/1992 | Takeda | 132/218 |
| 5,137,038 | A | | 8/1992 | Kingsford | 132/218 |
| 5,937,869 | A | | 8/1999 | Lhuisset | 132/218 |
| 5,951,185 | A | | 9/1999 | Kingsford et al. | 401/99 |
| 5,979,468 | A | * | 11/1999 | Blake, III | 132/318 |
| 6,213,661 | B1 | * | 4/2001 | Coon | 401/108 |

* cited by examiner

*Primary Examiner*—Todd E. Manahan
(74) *Attorney, Agent, or Firm*—Lerner, David, Littenberg, Krumholz & Mentlik, LLP

(57) ABSTRACT

A dispenser for fluid material such as cosmetic materials in the nature of mascara and the like is operative by one hand manipulation. The dispenser includes an internal reservoir for storage of an applicator attached to a post reciprocally received within a sleeve. A slider device is attached to the post having a portion accessible by the user. By one hand manipulation of the slider device, the applicator may be projected from the dispenser for use and retracted for storage. A closure member at one end of the dispenser may be opened and closed by manual manipulation or automatically by coupling to the slider device. Internal seals within the dispenser prevent evaporation of liquid and/or other volatile components of the fluid materials stored within the dispenser.

58 Claims, 7 Drawing Sheets

DISPENSER FOR FLUID MATERIALS

FIELD OF THE INVENTION

The present invention relates in general to dispensers for fluid materials such as cosmetic products, and more particularly, to dispensers for products having a semi-liquid or paste-like form such as mascara, wherein the dispenser includes a retractable applicator stored within the base of the dispenser providing a reservoir of the cosmetic product for application by the user.

Conventional mascara dispensers include a container that holds the mascara, a wiper, a rod to which there is attached an applicator, i.e., typically a twisted-in-wire brush, and a closure cap to which the rod is attached. The combined length of the rod and applicator is determined by the internal length of the container which forms a reservoir for the mascara. In use, the applicator is removed from the container interior upon removal of the closure cap, where it picks up mascara. The applicator passes through the wiper and opening of the container to the exterior, where it can be manipulated to apply the mascara. Subsequently, the applicator is returned to the container interior through the opening and wiper, where the applicator is resupplyed with mascara in the reservoir. An illustrative mascara dispenser of the foregoing type is described in Sheffler, et al., U.S. Pat. No. 5,875,791.

The wiper functions to control the amount of mascara that is carried on the applicator from the container during use. The wiper includes an aperture dimensioned less than the effective diameter of the applicator, thus removing by wiping excess mascara as the applicator passes through the wiper. However, the opening in the wiper is usually larger than the diameter of the attached rod to allow easy removal from the container. This often results in the rod becoming coated with mascara over its length. Further, as a result of the nature of the applicator, the user seldom applies all of the mascara carried by the applicator. The removal and reentry of the applicator through the wiper often results in a build-up of residual mascara on the outer side of the wiper. In time, an undesirable quantity of mascara collects at the entrance of the wiper and transfers the mascara onto the rod with each application. This condition is prevalent in all mascara dispensers on the market today, being referred to as "back-wipe." This condition is messy and unsightly and can cause smearing of the mascara on the hands, face or other parts of the user, including the user's clothing.

Conventional mascara dispensers where the applicator is attached to the closure cap, and is therefore fully immersed in the mascara when inserted in the container reservoir, also results in other undesirable conditions. As the applicator is withdrawn from the reservoir, a tail of mascara is formed at the applicator tip. This tail is undesirable, in that it is messy, as well as making it difficult to properly apply the mascara. Typically, the user removes the tail with a tissue or by brushing against the container mouth. In any event, the repeated tail formation must be removed with each repetitive use of the dispenser.

The conventional mascara dispensers thus far described include two separable components, a container that holds the mascara and a closure cap to which the applicator via a rod is attached. The application of mascara using the applicator therefore requires the use of two hands, one for holding the container and one for holding the closure cap. After unscrewing the closure cap and withdrawing the applicator, the container may be laid to rest while the mascara is being applied. Subsequently, the container must be picked up with the user's other hand, and the applicator via the closure cap reinserted into the container for storage and transfer of mascara from the reservoir to the applicator for subsequent use. The requirement for two hand manipulation of the mascara dispenser may be undesirable in certain situations where the user has only one hand free at the time.

There is known from Kingsford, U.S. Pat. No. 4,687,364, a mascara dispenser which addresses some of the aforementioned disadvantages of the known mascara dispensers. The mascara dispenser of Kingsford includes an elongated cylindrical container, open at one end, which provides therein a mascara reservoir having an opening. The container due to its elongated nature, also functions as a mascara applicator handle. A wiper for the mascara applicator is mounted in the reservoir opening. A mascara applicator is mounted on an elongated shaft for movement through the wiper between a position inside the reservoir and a position exterior to the container. A compression spring is positioned within the reservoir about a portion of the shaft. A protrusion from the shaft that is larger than the wiper opening prevents the applicator shaft from becoming detached from the reservoir when the applicator is in its position outside the container. A closure cap is removably attached to the opening of the container. The cap is provided with a pin to push the shaft and attached applicator through the wiper opening into its storage position in the reservoir and simultaneously close the opening to the container. When the closure cap is removed, the applicator is released by the compressive force of the spring to move the applicator through the wiper to its position outside of the container for use.

There is further known from Kingsford, et al., U.S. Pat. No. 5,951,185 a mascara dispenser constructed from an elongated container providing an internal reservoir for holding a quantity of mascara. An applicator, for example, a brush-type applicator, is retractably arranged within the container to be movable between a location within the reservoir and a location outside the container for application of the mascara by means of the brush applicator. A wiper for the applicator is positioned at one end of the container through which the applicator passes during use. A movable member is positioned within the reservoir so as to be responsive to the location of the applicator for keeping the wiper out of contact with the applicator during retraction of the applicator into the reservoir and for keeping the wiper in contact with the applicator when the applicator is moved out of the reservoir. The applicator is moved between its retracted and extended positions by a sliding actuator accessible from outside the container. Mascara within the reservoir is maintained under a compressive force by means of a spring bias movable wall positioned at one end of the reservoir within the container.

There is also known a dispenser for a lipstick billet which is constructed to facilitate one hand application. The dispenser includes an elongated generally cylindrical container having a hollow interior. A holder to which the lipstick billet is attached is slidably received within the container. The holder is attached to a flexible band having one end protruding through an opening in the container so as to be accessible by the user. The container is provided with an open end having a closure member which is operatively associated with the flexible band. Upon longitudinal movement of the flexible band, the lipstick billet is moved from a retracted position within the container to an exterior position to enable application to the user, while at the same time, simultaneously opening and closing the closure member.

Notwithstanding these known dispensers, there is still the need for further improvements in cosmetic dispensers for fluid materials, and particularly, mascara which overcomes the aforementioned disadvantages resulting from the construction and use of the known cosmetic dispensers.

SUMMARY OF THE INVENTION

It is broadly an object of the present invention to provide a dispenser for fluid materials, such as mascara, which provides features and advantages heretofore unknown.

In accordance with one embodiment of the present invention there is described a dispenser for fluid material, the dispenser comprising an elongated shell having a closed end and an open end providing an interior portion therebetween for receiving a quantity of fluid material, an elongated sleeve within the interior portion having a first open end supported within the shell and a second open-end opposing the open end of the shell, a post slidably received with the sleeve having a first end opposing the closed end of the shell and a second end opposing the open end of the shell, an applicator attached to the second end of the post for delivering fluid material from the interior portion of the shell, and a slider device having a first end attached to the post and a second end accessible outside the shell, whereby manipulation of the second end of the slider device between a first and second position is operative for displacement of the applicator from a first position within the interior portion of the shell to a second position exterior of the shell upon passage through the open end of the shell.

In accordance with another embodiment of the present invention there is described a dispenser for cosmetic material, the dispenser comprising an elongated outer shell concentrically arranged about an inner elongated sleeve defining therebetween a reservoir for receiving a quantity of cosmetic material, an elongated post slidably received within the sleeve, a cosmetic applicator arranged within the reservoir and attached to one end of the post, and a device having a first portion attached to the post and a second portion accessible from outside the shell, the device moveable by manipulation of the second portion whereby the applicator is displaced from within the reservoir to a location outside the shell for application of cosmetic material retained on the applicator.

In accordance with another embodiment of the present invention there is described a dispenser for cosmetic material, the dispenser comprising an elongated cylindrical shell having a closed end and an open end defining therebetween a reservoir for receiving a quantity of cosmetic material, an elongated cylindrical sleeve concentrically arranged within the reservoir having a first open end and a spaced apart second open end opposing the open end of the shell, an elongated post slidably received within the sleeve having a first end opposing the closed end of the shell and a second end opposing the open end of the shell, a seal member at the open end of the sleeve having a portion in sliding contact with the exterior surface of the post, a wiper within the reservoir of the shell adjacent the open end thereof, the wiper having an opening in communication with the open end of the shell, an applicator attached to the second end of the post for delivering cosmetic material from the reservoir, a closure member within the shell outwardly of the open end thereof, the closure member having an opening extending therethrough for communicating with the reservoir, the closure member moveable between an open position wherein the opening is in alignment with the open end of the shell and a closed position wherein the opening is out of alignment with the open end of the shell to prevent passage of the applicator therethrough, a slider having a first end attached to the first end of the post and a second end accessible outside the shell, whereby manipulation of the slider between a first and second position is operative for displacement of the applicator from a first position within the reservoir to a second position exterior of the shell upon passage through the open end of the shell and the opening with the closure member, and means for maintaining the cosmetic material when present in the reservoir under a compressive force.

BRIEF DESCRIPTION OF THE DRAWINGS

The above description, as well as further objects, features and advantages of the present invention will be more fully understood with reference to the following detailed description of a dispenser for fluid materials, when taken in conjunction with the accompanying drawings, wherein.

DETAILED DESCRIPTION OF THE PREFERRED EMBODIMENTS

In describing the preferred embodiments of the subject matter illustrated and to be described with respect to the drawings, specific terminology will be resorted to for the sake of clarity. However, the invention is not intended to be limited to the specific terms so selected and is to be understood that each specific term includes all technical equivalents which operate in a similar manner to accomplish a similar purpose.

Figures 1, 2, 3, 4, 5:
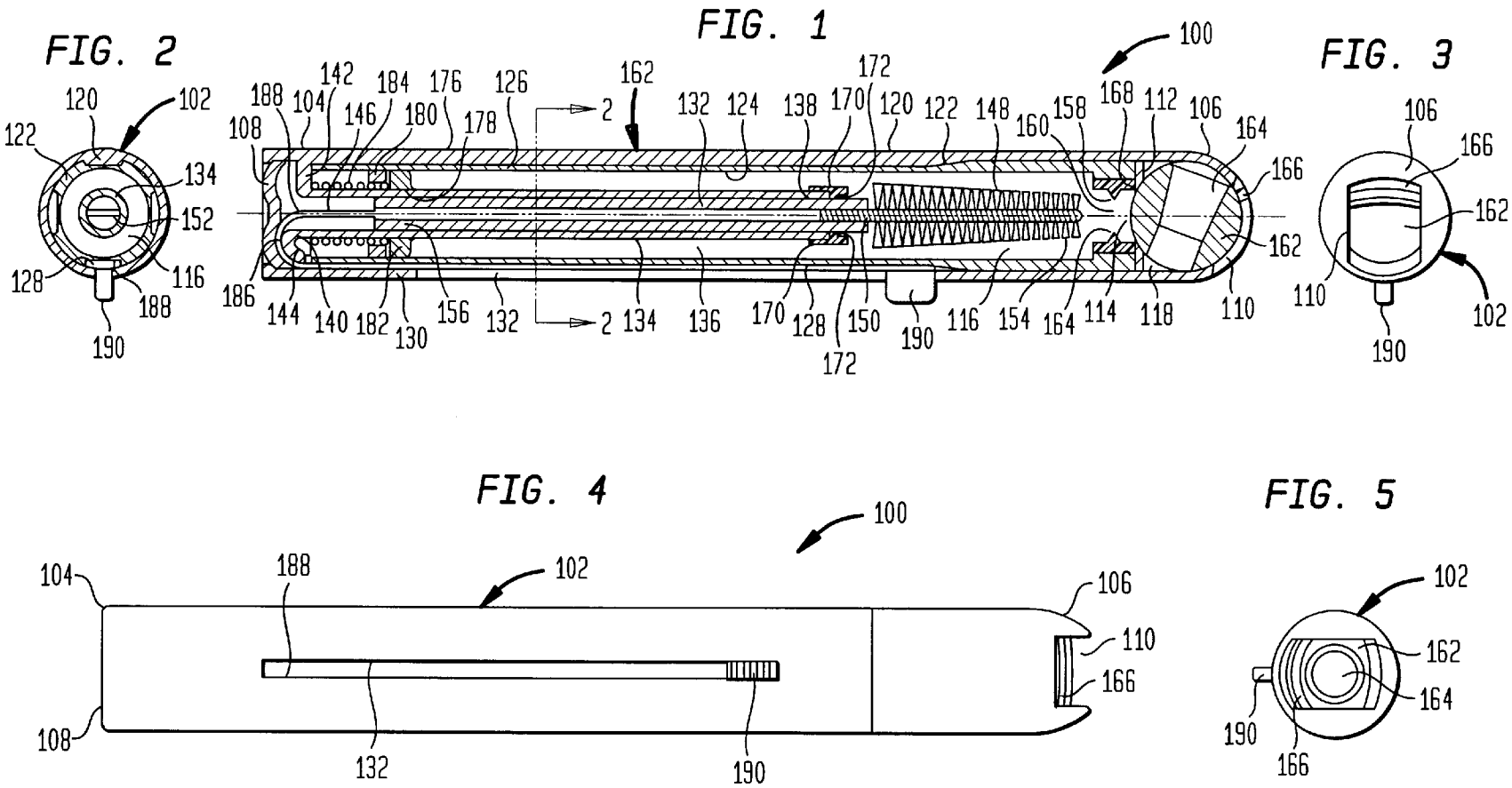
FIG. 1 is a cross-sectional view of a dispenser constructed in accordance with one embodiment of the present invention showing its component parts in operative assembled relationship.
FIG. 2 is a cross-sectional view of the dispenser taken along line 2—2 in FIG. 1.
FIG. 3 is a right side elevational view of the dispenser showing a portion of the closure member.
FIG. 4 is a front elevational view of the dispenser as shown in FIG. 1.
FIG. 5 is a right side elevational view of the dispenser as shown in FIG. 4 with the closure member in an open position.

Referring to the drawings, wherein like reference numerals represent like elements, there is shown in FIG. 1 a fluid material dispenser generally designated by reference numeral 100. As used herein, the term "fluid material" refers to materials which are themselves liquid or incorporate a liquid vehicle, e.g., particularly cosmetic compositions such as those having a semi-solid or paste-like form. One cosmetic particularly suitable for dispensing with the dispenser 100 of the present invention is mascara. However, other cosmetic materials such eyeliner, lip gloss, lipstick, eye shadow, rouge, nail polish and the like are also suitable for dispensing by the dispenser 100 pursuant to the present invention.

Referring to FIGS. 1–3, the dispenser 100 includes an elongated outer shell 102 having a first end 104 and a second end 106. The first end 104 is sealed or closed to the surrounding exterior by means of a wall member 108. The second end 106 is provided with an opening 110 to provide general communication with the interior of the dispenser 100. A dividing wall 112 in the nature of a washer having an opening 114 is secured transversely within the interior of the dispenser 100 adjacent the opening 110. The dividing wall 112 divides the interior of the dispenser 100 into an interior portion or reservoir 116 and a closure receiving cavity 118.

The shell 102 generally includes an outer shell 120 which defines the shape of the dispenser 100 and an inner shell 122, which as shown, is arranged extending between the dividing wall 112 and a location adjacent the first end 104 of the dispenser 100. The inner shell 122 has an interior surface 124 which generally defines the perimeter or bounds of the reservoir 116. The exterior surface 126 of the inner shell 122 is generally supported along the interior surface of the outer shell 120. The cross-sectional thickness of the inner shell 122 has one or more longitudinally extending regions 128 of reduced thickness to define a corresponding elongated channel 130 with the interior surface of the overlying portion of the outer shell 120. An elongated slot 132 is formed in the outer shell 120 in alignment with one of the regions 128 of reduced thickness in the inner shell 122.

An elongated hollow cylindrical sleeve 134 is concentrically arranged within the interior of the shell 102, being spaced from the inner shell 122 to define an annular region 136. The sleeve 134 has a first open end 138 opposing the opening 114 in the dividing wall 112 and a second end 140 opposing wall member 108. The second open end 140 is integrally formed with a surrounding annular flange 142 which is circumferentially attached to an interior portion of the shell 102 for support of the sleeve 134. An opening 144 is provided in the flange 142 arranged to provide a passageway to enable communication between the channel 130 and the interior 146 of the sleeve 134.

An applicator 148 is positioned within the reservoir 116 having its base 150 attached to an elongated post 152. As previously noted, the applicator 148 may be in the nature of a twisted-in-wire brush or other suitable design for application of the fluid material. For example, other applicators 148 may be in the nature of a miniature comb, preformed swab, sponge applicator, flocked applicator known as "Doe Foot", and the like. When the dispenser 100 is intended for the application of mascara, the applicator will generally be in the nature of a twisted-in-wire brush as illustrated having a tapered, uniform or other shaped profile. The post 152 is dimensioned so as to provide a sliding friction fit with the interior surface of the sleeve 134. The combined length of the post 152 and attached applicator 148 is such that the tip 154 of the applicator is proximate the dividing wall 112 while the opposing end 156 of the post is adjacent flange 142. As illustrated in FIG. 1, the applicator 148 is shown in its retracted position to reside within the reservoir 116 which will be filled with the fluid material, for example, mascara.

A wiper 158 is attached to the inner shell 122 adjacent the dividing wall 112. The wiper 158 is provided with an opening 160 in communication with the opening 114 in the dividing wall 112. In the preferred embodiment, the opening 160 is dimensioned to generally be smaller than the size of the applicator 148. The wiper 158, as is well known in the art of mascara dispensers, functions to remove excess mascara from the applicator 148 as the applicator passes through the opening 160. Various designs for the wiper 158 are well known in the art of mascara dispensers to achieve the proper wiping action.

In accordance with the preferred embodiment, the opening 160 in the wiper 158 is also sized in conjunction with the post 152 to provide close tolerance therebetween, while allowing relative free sliding movement of the post through the opening. The opening 160 is defined by an inwardly directed circumferential member 161. As the post 152 is extended through the opening 160, any accumulated fluid material from within the reservoir 116 is scraped off the exterior surface of the post to be retained within the reservoir. Thus, when the applicator 148 is advanced from within the reservoir 116 for use, that portion of the post 152 extending outwardly of the shell 102 will have a clean, fluid free exterior surface. In addition, the engagement of the wiper 158 with the post 156 will create a seal thereat when the dispenser 100 is in the use position thereby preventing evaporation of liquid or volatile components from the fluid material within the reservoir 116.

The dispenser 100 is provided with a plurality of seals to prevent fluid material within the reservoir 116 from leaking out and/or prevent evaporation of liquid or volatile components of the fluid material. Most notably is the presence of a closure member 162 captured within the cavity 118 between openings 110, 114. By way of one example, the closure member 162 is formed as a spherical member having a circumferential portion seated within the opening 114 of the dividing wall 112 and another circumferential portion in sliding contact with the interior surface of the shell 102 adjacent the second end 106 surrounding opening 110. Contact between the exterior surface of the closure member 162 with a portion of the dividing wall 112 defining the opening 114 functions as a seal or closure to the reservoir 116 and its contents. By virtue of the shape of the cavity 118 and the closure member 162, the closure member is operative for rotation or other movement within the cavity. The closure member 162 is provided with an opening 164 extending through the closure member. The opening 164 is sized to accommodate the passage therethrough of the applicator 148 and post 152 during use of the dispenser 100. A projection 166 extends outwardly from the closure member 162 through opening 110. The projection 164 may be engaged by one's fingers or by an opposing surface to enable rotation or movement of the closure member 162 to effect alignment and non-alignment of the opening 164 with openings 114, 110. As shown in FIG. 1, the opening 164 is not in alignment with openings 110, 114, whereby the dispenser 100 is in a sealed or closed condition. The closed condition of the dispenser 100 prevents leakage of the fluid material from the reservoir 116, as well as preventing evaporation of volatile liquids which may be contained in the reservoir 116 which form all or a portion of the fluid material to be dispensed. An additional seal is provided adjacent the opening 114 by a portion 168 of the wiper 158 being pressed against the surface of the dividing wall 112.

A seal member 170 of suitable elastomeric material is attached circumferentially about the first open end 138 of sleeve 134. The seal member 170 has an inwardly projecting portion 172 formed by an opening within the seal member. The inwardly projecting portion 172 is constructed to engage the exterior surface of the post 152 to form a seal thereat, while at the same time, providing relative sliding motion therebetween. In accordance with one embodiment as shown, the seal member 170 is in the nature of an annular member having one end attached about the circumference of the sleeve 134. The inwardly projecting portion 172 is arranged outwardly of the first open end 138 in the nature of an annular ring which circumscribes the circumference of the post 152. The construction of the seal member 170 prevents fluid material within the reservoir 116 from leaking into the interface between the interior surface of the sleeve 134 and the exterior surface of the post 152. The presence of the seal member 170 is preferred in that the fluid material within the reservoir 116 is generally maintained under a compressive force as to be described.

In use, the applicator 148 removes a portion of the fluid material within the reservoir 116 each time the applicator is dispensed. It is therefore a tendency of the applicator 148 to form a hollow cavity within the reservoir 116 which will be devoid of the fluid material, particularly when of a paste-like consistency such as mascara. In order to keep the fluid material within the reservoir 116 in contact with the applicator 148, it is desirable to maintain the fluid material under a slight constant compressive force. By maintaining a constant compressive force, the fluid material will flow into any void created by the applicator 148. This enables the complete use of the fluid material within the reservoir 116 regardless of its location, i.e., adjacent the applicator 148 or in the annular region 136 about the sleeve 134.

In accordance with one embodiment of the present invention, an annular shaped piston 176 having a central opening 178 is slidably received about the sleeve 134 occupying the space between the exterior surface of the sleeve and the interior surface 124 of the inner shell 122. A portion of the piston 176 forms a first seal 178 between the piston and the interior surface 124 of the inner shell 122. Another portion of the piston 176 forms a second seal between the piston and the exterior surface of the sleeve 134. The piston can be constructed from any suitable material, such as high density polyethylene material. As a result of the foregoing construction, the piston 176 is slidable along the sleeve 134 while maintaining a seal between the interior surface 124 of the inner shell 122 and exterior surface of the sleeve 134. The first and second seals 178, 180 are operative to prevent fluid material within the reservoir 116 from bypassing the piston 176 when the fluid material is under a compressive force due to action of the piston.

The piston 176 provides a constant compressive force against the fluid material within the reservoir 116. In accordance with one embodiment, a coiled compression spring 184 is positioned between the piston 176 and flange 142. The spring 184 urges the piston 176 under constant spring force against the fluid material. As the fluid material 116 is dispensed by the applicator 148, the piston will advance to the right, as shown in FIG. 1, due to the action of the spring 184. As the piston 176 advances, fluid material within the reservoir 116 will have a tendency to refill the void created by removal of the applicator 148. The spring force is sufficient to cause fluid motion of the fluid material, but insufficient to force the fluid material past the seals formed within the dispenser 100, e.g., seal member 170, closure member 162, first and second seals 180, 182 and cooperation between the exterior surface of the sleeve 134 and projecting member 161 of the wiper 158. From the foregoing description, it should now be apparent that the reservoir 116 and fluid material contained therein is maintained within the dispenser 100 in a sealed environment during use and storage of the dispenser to prevent evaporation of liquids and/or volatile components from the fluid material.

Figure 6:
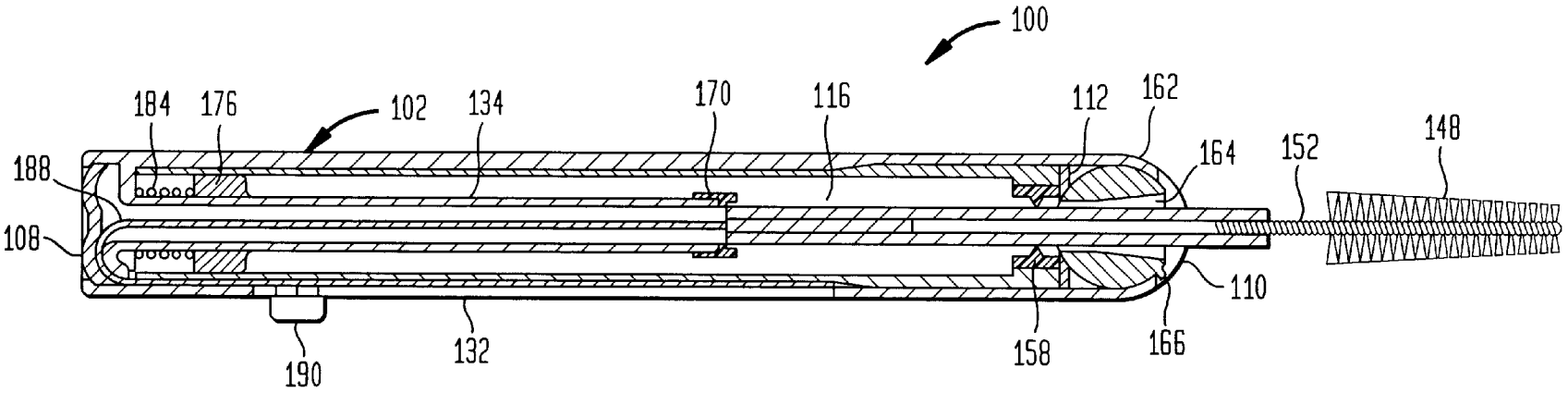
FIG. 6 is a cross-sectional view of the dispenser in an operative position with the applicator extended outwardly for application of the stored fluid material.

The dispenser 100 further includes a slider device generally designated by reference numeral 186 which is operative for manipulation and movement of the applicator 148 from a retracted storage position within the reservoir 116 to an extended user position as shown in FIG. 6. In the user position, the applicator 148 is accessible for applying the fluid material stored thereon, e.g., mascara, to eyelashes and the like. The slider device 186 is constructed from an elongated flexible band 188 having one end attached to end 156 of the post 152. The band extends through the interior 146 of the sleeve 134 and outwardly through opening 144 into the channel 130 formed between the outer shell 120 and inner shell 122. The band extends underlying the slot 132 within the outer shell 120 where it terminates at an outwardly extending projection 190. The band 184 is sized to provide a sliding fit within the channel 130 by longitudinal movement of the projection 190 within the slot 132.

The dispenser 100 and its component parts as thus far described can be constructed from a variety of materials, preferably, from polymer materials. By way of example only, the outer shell 120 and the post 152 can be constructed from acrylonitrile-butadiene-styrene copolymer material. The wall member 108, flexible band 188, piston 176 and wiper 158 can be constructed from high density polyethylene material. The seal member 170 is preferably constructed from elastomeric material. The inner sleeve 122 is preferably constructed from polypropylene material while the applicator 148 is preferably constructed from nylon in the form of bristles. The dividing wall 112 and closure member 162 are preferably constructed from acetal polymer material. It is understood that the spring 180 typically is constructed from steel material. It is therefore to be understood that other polymer materials may be used in the construction of the dispenser 100 and its component parts.

Although the shell 102 has been described as being cylindrical, it can have other geometric shapes such as triangular, rectangular, octagon, oval and the like. Similarly, the profile of the sleeve 134 may have a profile to match the shape of the post 152 which may also be other than cylindrical. Accordingly, it is to be understood that the dispenser 100 may be constructed in a variety of materials and shapes while embodying the principles of the present invention.

The operation of the dispenser 100 will now be described generally with reference to FIGS. 1–6, and specifically, with reference to the application of mascara. The dispenser 100 is filled with mascara within the reservoir 116 which also includes the annular region 136. The mascara is maintained under a slight compressive force by the piston 176 being urged against the mascara by operation of spring 184. Due to the paste-like nature of the mascara surrounding the applicator 148, the mascara will impregnate between the individual bristles of the applicator.

The dispenser 100 is designed to be operative with one hand of the user, thereby leaving the user's other hand free for other tasks. The dispenser 100 is shown in FIG. 1 in a closed condition with the post 152 and applicator 148 in their retracted position and the closure member 162 in a closed position to seal opening 114 in the dividing wall 112. In this position, the projection 166 of the closure member 162 extends slightly outwardly through the opening 110 in shell 102. The user engages the projection 166 by one's finger or a portion of their body or other object so as to rotate the closure member, clockwise as shown in FIG. 1, thereby aligning opening 164 within the closure member with opening 114 within the dividing wall 112. The open position of the closure member 162 provides communication between the exterior of the dispenser 100 and the reservoir 11.6, as well as the aligning with applicator 148.

The user next engages the projection 190 which is attached to band 188, sliding same longitudinally through slot 132 towards wall member 108. As the projection 190 is slid longitudinally, the other end of the band 188 causes the post 152 to slide longitudinally through sleeve 134 in the opposite direction pushing the applicator 148 through the wiper 158 and aligned openings 114, 164 so as to project outwardly of the dispenser 100 as shown in FIG. 6. As the applicator 148 passes through the restricted opening 160 in the wiper 158, excess mascara is removed from the applicator 148. At the same time, any tail of mascara which would otherwise form on the tip of the applicator 148 is either removed or is not formed. As the post 152 passes through the reservoir 116, there is the potential for accumulation of mascara on the exterior surface of the post. As shown in FIG. 6, that portion of the post 152 extending outwardly from the wiper 158 is cleaned of any mascara by contact with the wiper 158. Thus, that portion of the post 152 exposed outside the dispenser 100 does not drag along mascara which would potentially get on the user's fingers or clothing.

The applicator 148 is retracted into the interior of the dispenser 100 in the reverse of the aforementioned procedure. In this regard, the projection 190 is slid longitudinally in the opposite direction, i.e., to the right in FIG. 1. This causes the flexible band 188 to pull the post 152 and attached applicator 148 back into the reservoir 116 through the opening 164 in the closure member 162, the opening 114 in the dividing wall 112 and the opening 160 within the wiper 158. At such time, the closure member 162 can be rotated into its closed position by engagement with the projection 166. Once closed, the reservoir 116 is in a sealed condition to minimize any evaporation of liquid or volatile components from the mascara. By operation of the piston 176, the mascara within the reservoir 116 will flow in order to fill any void created by the absence of the applicator 148 thereby redepositing the mascara onto the applicator for subsequent use.

Figure 7:
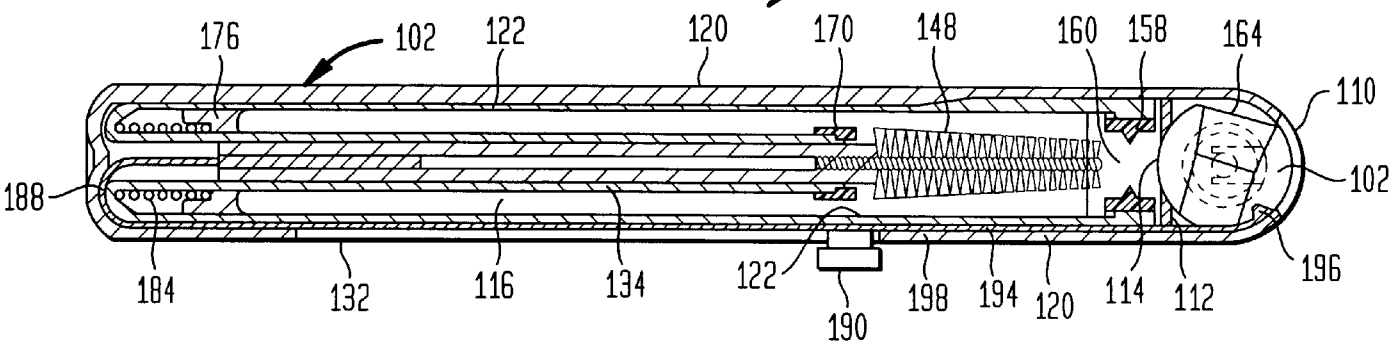
FIG. 7 is a cross-sectional view of a dispenser showing its component parts in operative assembled relationship constructed in accordance with another embodiment of the present invention.
Figure 8:
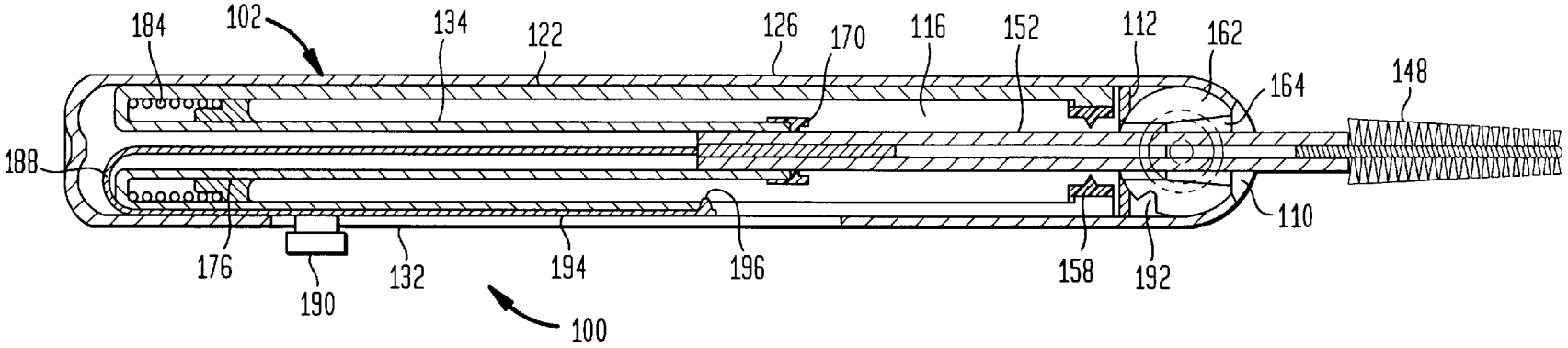
FIG. 8 is a cross-sectional view of the dispenser as shown in FIG. 7 in an operative position with the applicator extended outwardly for application of the stored fluid material.

Referring now to FIGS. 7 and 8, there will be described another embodiment of the dispenser 100 constructed in accordance with the present invention. As thus far described, the closure member 162 is rotated between open and closed positions by manual manipulation of the projection 166. As shown in FIGS. 7 and 8, the closure member 162 is provided with a notch 192 extending radially inwardly from its outer surface. The flexible band 188 is provided with a longitudinal extension 194 forward of projection 190. The extension 194 terminates at an inwardly projecting boss 196 sized and shaped to be releasably received within the notch 192 within the closure member 162. The extension 194 is slidingly received within a channel 198 formed between the outer shell 120 and inner shell 122. The dispenser 100 is shown in its closed position in FIG. 7 with boss 196 captured within the notch 192 of the closure member 162. With the projection 190 at its rightmost position as shown in FIG. 7, the closure member 162 maintains the dispenser 100 in a sealed condition.

In use, the projection 190 is slid longitudinally to the left, as shown in FIG. 8, to effect longitudinal movement of the extension 194. As the extension 194 is slid to the left, the boss 196 will cause rotation of the closure member 162 in a clockwise direction to align its opening 164 with the opening 114 in the dividing wall 112. Once the openings 114, 164 are aligned, the continued manipulation of the projection 190 will cause the applicator 148 and post 152 to slide outwardly through the wiper 158 and through the closure member 162 to provide access to the applicator 148.

The applicator 148 may be retracted in a reverse operation. In this regard, the projection 190 is slid longitudinally to the right so that the boss 196 will be recaptured within the notch 192 causing counterclockwise rotation of the closure member 162 into its sealed condition, while at the same time, retracting the applicator 148 and post 152. From the foregoing description, the boss 196 by being attached to the extension 194 is operative for engaging and releasing within the notch 192 of the closure member 162 to effect its clockwise and counterclockwise rotation to open and close the dispenser 100. At the same time, the applicator 148 and its attached post 152 is extended and retracted from within the reservoir 116 for use and/or storage.

Figure 9:
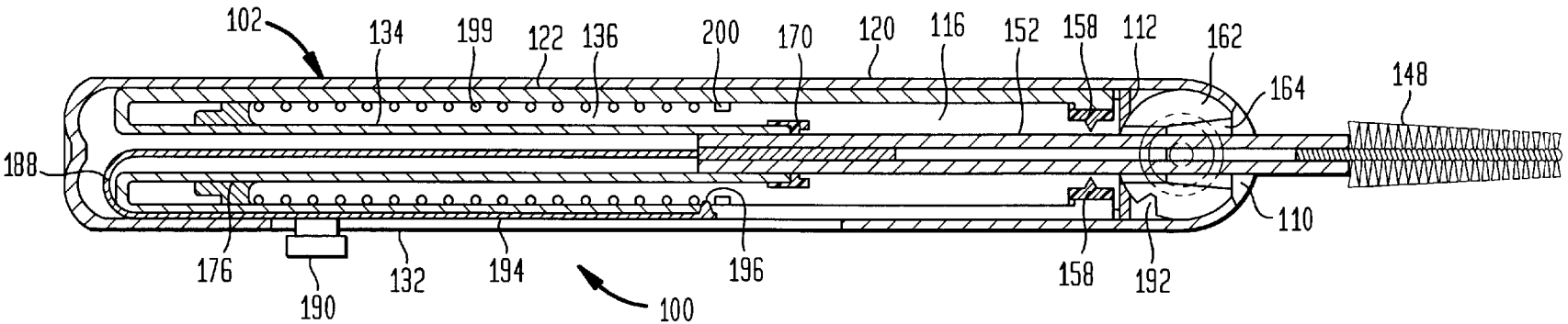
FIG. 9 is a cross-sectional view of a dispenser showing its component parts in operative assembled relationship constructed in accordance with another embodiment of the present invention.

As thus far described, the piston 176 maintains the fluid material within the reservoir 116 under a compressive force by means of spring 184. Spring 184 is maintained under compression by being positioned between the piston 176 and flange 142 as shown in FIG. 1. In the embodiment shown in FIG. 9, a spring 199 is positioned within the annular region 136 of the reservoir 116 extending about sleeve 134. One end of the spring is attached to the piston 176, while the other end is attached to a projection 200 extending inwardly from the inner shell 122 into the annular region 136. The spring 199 is maintained under tension to pull the piston 176 against the fluid material within the reservoir 116 thereby maintaining same under compression.

Figure 10:
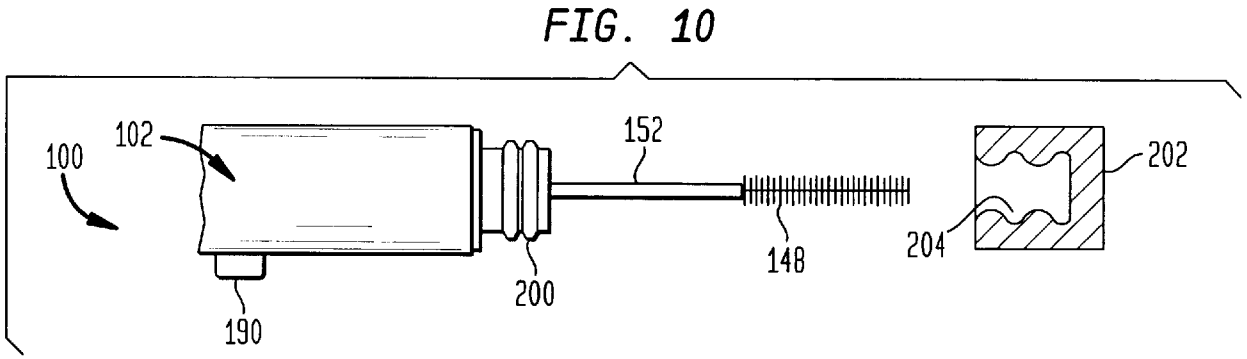
FIG. 10 is a diagrammatic illustration of the construction of a dispenser having a closure member in accordance with another aspect of the present invention.

The dispenser 100 as described with respect to FIG. 1 provides flange 142 of the sleeve 134 attached to the outer shell 120. Separately provided is the inner shell 122 which surrounds the reservoir 116. In another embodiment of the present invention as shown in FIG. 8, the inner shell 122 may be integrally formed with the sleeve 134 as a concentric member, which components are received within the outer shell 120 and locked in place by any suitable means. In accordance with another embodiment as shown in FIG. 10, the dispenser 100 is provided with a conventional threaded neck 201 to be closed by a conventional cap 202 having corresponding internal threads 204. The dispenser 100 is put into use by first unscrewing cap 202 and then manipulating the projection 190 to extend the applicator 148. In this embodiment of the dispenser 100, the applicator 148 may be extended by spring loading the post 152 by inserting a coiled compression spring (not shown) within the end of the sleeve 134. When the cap 202 is removed, the applicator 148 will automatically project itself outwardly of the dispenser 100. The applicator 148 may be retracted by forcing same inwardly upon reattaching the cap 202 about the threaded opening 201 of the dispenser 100.

Figure 12:
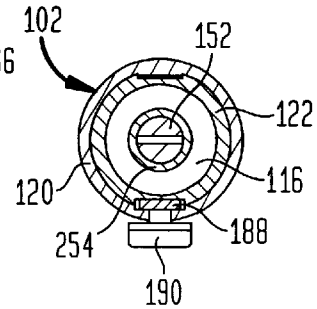
FIG. 12 is a cross-sectional view of the dispenser taken along line 12—12 in FIG. 11.
Figure 11:
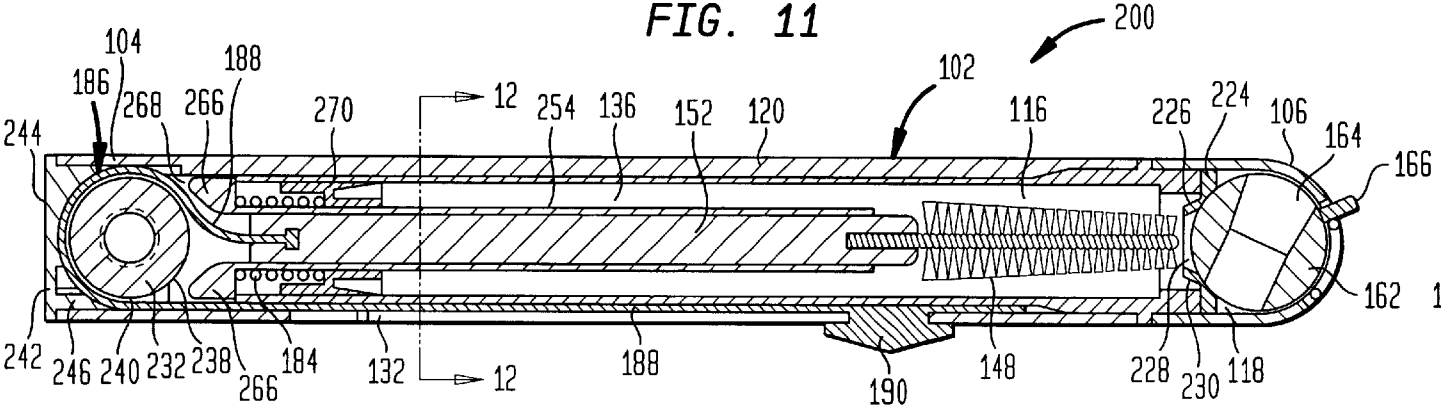
FIG. 11 is a cross-sectional view of a dispenser constructed in accordance with another embodiment of the present invention showing its component parts in operative assembled relationship.
Figure 13:
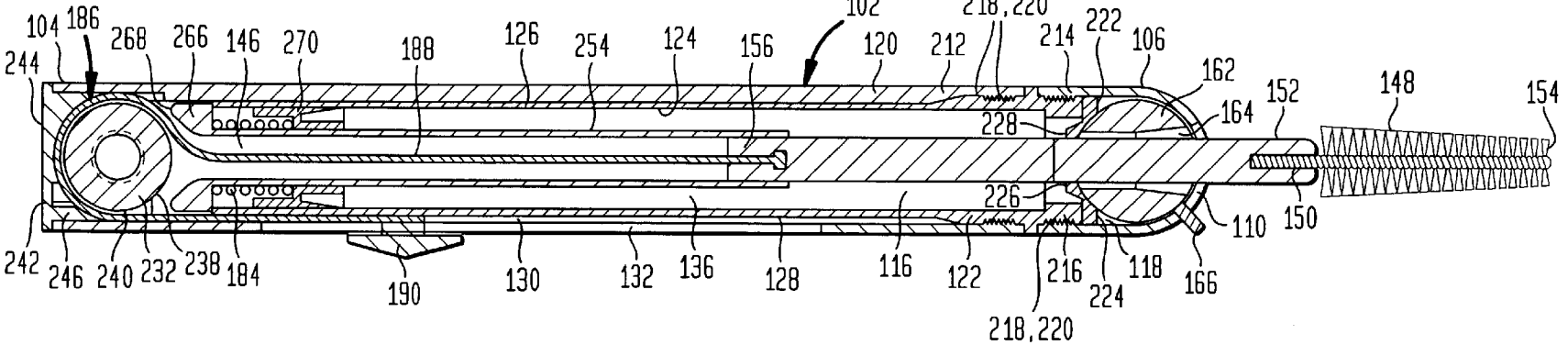
FIG. 13 is a cross-sectional view of the dispenser in an operative position with the applicator extending outwardly for application of the stored fluid material.

Referring now to FIGS. 11–21, there will be described a dispenser 210 constructed in accordance with one preferred embodiment of the present invention. The dispenser 210, like the dispenser 100, are designed for one hand operation. In view of similar components and their function between the dispensers 100, 210, like elements will be given like reference numerals. Referring specifically to FIGS. 11–13, the outer shell 120 may be constructed from two components, an elongated cylindrical member 212 and a U-shaped cup member 214 having opening 110. The cylindrical member 212 and cup member 214 are joined together in longitudinal alignment by attachment to a circumferential portion 216 of the inner shell 122. The circumferential portion 216 is provided with a plurality of circumscribing ribs 218 which are captured in corresponding grooves 220, or vice versa, on the mating cylindrical member 212 and cup member 214.

A wiper 222 constructed from polymer material, for example, low density polyethylene, is positioned within the cup member 214 adjacent the free end of the inner shell 122. The wiper 222 is provided with an annular flange 224 which sits against the end of the inner shell 122 so as to support an integrally formed cone shaped member 226 extending into the reservoir 116. The cone shaped member 226 is provided with a central opening 228 similar to the opening 160 formed in wiper 158 as shown in FIG. 1. The opening 228 enables passage of the applicator 148 so as to control the cosmetic material being retained by the applicator. In addition, the opening 228 may be sized to provide a sliding or friction-like fit against the exterior surface of the post 152 to scrape off or preclude cosmetic material from being dragged from the reservoir 116 through the opening 228. The cone shaped member 226 and flange 224 form a seat region 230 for sealing engagement with the exterior surface of the closure member 162. The seat region 230 will generally be defined as an annular ring having a curved inner surface generally conforming to the radius of curvature of the closure member 162 to enable an effective and efficient seal therebetween. The integrally formed wiper 222 which includes the flange 224 and cone shaped member 226 functions as the wiper 158 and dividing wall 112 previously described with respect to the embodiment disclosed in FIG. 1.

Figure 17:
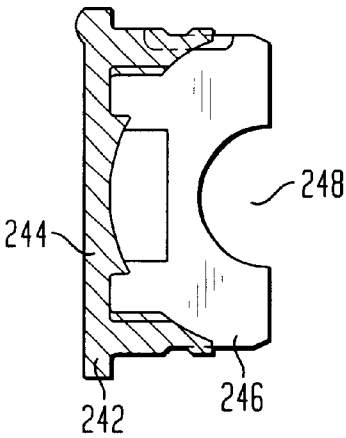
FIG. 17 is a cross-sectional view of a plug for closing one end of the dispenser.
Figure 18:
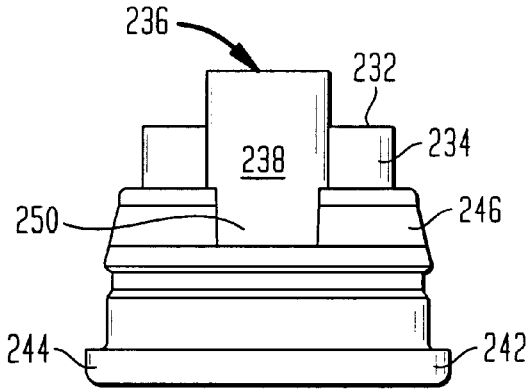
FIG. 18 is a front elevational view of the plug.
Figure 19:
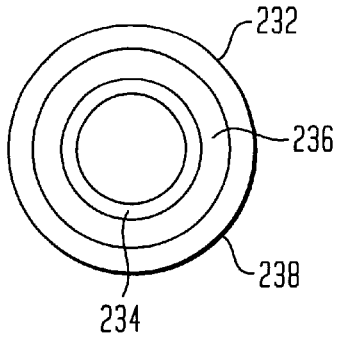
FIG. 19 is a front elevational view of a guide for support of a slider device for actuation of the dispenser.
Figure 20:
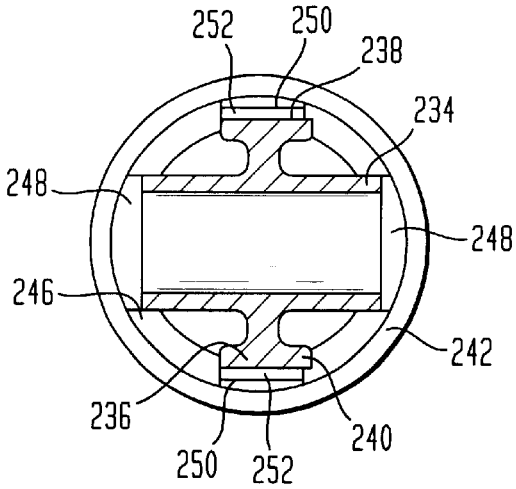
FIG. 20 is an assembled front elevational view of the guide in operative association with the plug.

A guide 232 is positioned within the interior of the shell 102 adjacent first end 104. The guide 232 as further shown in FIGS. 19 and 20, includes a cylindrical member 234. A T-shaped member 236 extends circumferentially about the cylindrical member 234 midway along its length. The T-shaped member 236 includes an outwardly facing planar surface 238 formed by flange 240. Although the guide 232 is shown to include a hollow cylindrical member 234, the cylindrical member may be solid. The guide 232 is supported within the shell 102 by a plug 242. The plug 242 is received within the first end of the shell 102 to provide a closed end thereat. The plug 242 includes a solid base 244 and an upstanding cylindrical sidewall 246 which circumscribes the base. As best shown in FIGS. 17, 18 and 20, the sidewall 246 is provided with a pair of opposed semicircular cutouts 248. The semicircular cutouts 248 have a radius sized to receive the cylindrical member 234 of the guide 232. The guide 232 may be stationarily fixed to the plug 242 or allowed to rotate within the semicircular cutouts 248. Sidewall 246 is further provided with a pair of spaced apart rectangular cutouts 250 which are arranged 90° apart from the circular cutouts 248. As best shown in FIGS. 18 and 20, the rectangular cutouts 250 cooperate with the planar surface 238 of the T-shaped member 236 to form a passageway 252 circumferentially about that portion of the guide 232 received within the plug 242.

Figure 14:
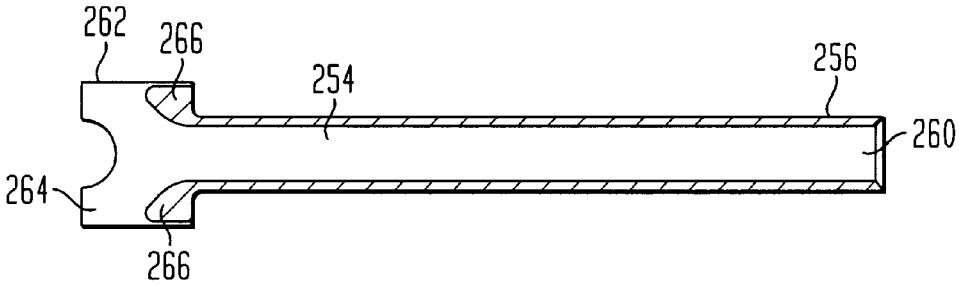
FIG. 14 is a cross-sectional view of an internal sleeve for supporting an applicator post within the dispenser.
Figure 15:
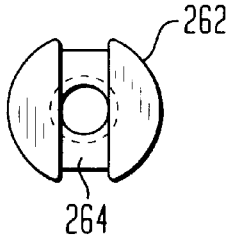
FIG. 15 is a left side elevational view of the sleeve shown in FIG. 14.
Figure 16:
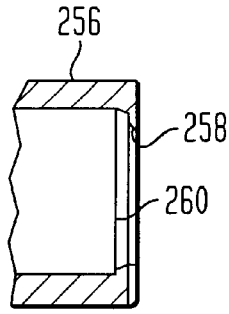
FIG. 16 is an enlarged cross-sectional view of the end of the sleeve illustrating an integral seal.

Sleeve 254, as further shown in FIGS. 14–16, has a free end 256. The free end 256 is formed with a restricted opening by means of an annular ridge 258 extending inwardly about opening 260. The annular ridge 258 is sized so as to provide a conforming or sliding friction fit about the exterior surface of post 152. In this manner, the annular ridge 258 functions as a seal in a similar manner as seal member 170 as shown and described with respect to the dispenser 100. The annular ridge 258 may be formed integral with the sleeve 254. The other end of the sleeve is provided with a barrel shaped member 262 provided with an opening 264. The end of the sleeve 254 within the opening 264 is formed by two spaced apart guide members 266. As shown in FIGS. 11 and 12, the guide members 266 via the opening 264 cooperate with flange 240 on the guide 232 to form a passageway 268 therebetween. As shown, the barrel shaped member 262 is positioned adjacent the guide 232. Based upon the foregoing assembled construction, the band 188 of the slider device 186 extends from projection 190 through passageways 252, 268 into the interior 146 of the sleeve 254 to be attached to the post 156. Sliding manipulation of the projection 190 will cause the band 188 to advance and retract through the passageways 252, 268 to effect longitudinal movement of the post 156, and hence, the applicator 148 from its operative to inoperative location within and outside the shell 102 of the dispenser 210.

Figure 21:
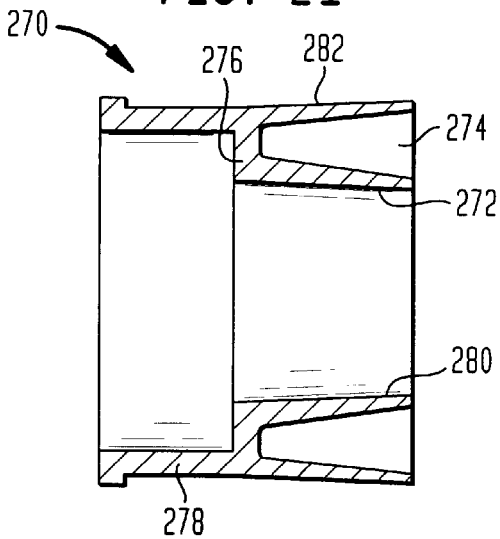
FIG. 21 is a cross-sectional view of a sealable piston positioned within the reservoir of the dispenser.

A piston 270, functioning in the same manner as piston 176, is provided about the sleeve 152 in the annular region 136. As best shown in FIG. 21, the piston 270 is formed as a cylindrical member having an annular body 272 formed with an annular opening 274 and provided with an end wall 276 from which there extends a cylindrical sidewall 278. The annular body 272 is formed from an inner flange 280 and a spaced apart outer flange 282. The piston 270 is constructed from suitable polymer material such as, for example, high density polyethylene to provide resiliency. In assembled relationship, spring 184 is urged against end wall 276 to maintain cosmetic material within the reservoir 116 under a compressive force. As the piston 270 is slid longitudinally about the exterior of the sleeve 254, the inner flange 280 forms a sliding seal thereat, while the outer flange 282 forms a sliding seal with the interior surface of the inner shell 122.

The construction of the dispenser 210 having been described, it is to be understood that its operation is similar to that previously described with respect to the dispenser 100. It is also to be understood that the dispenser 210 can be constructed from similar materials as described with respect to the dispenser 100, as well as other modifications as thus far described.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A dispenser for fluid material, said dispenser comprising an elongated shell having a closed end and an open end providing an interior portion therebetween for receiving a quantity of fluid material, an elongated sleeve within said interior portion having a first open end supported within said shell and a second open-end opposing said open end of said shell, a post slidably received with said sleeve having a first end opposing said closed end of said shell and a second end opposing said open end of said shell, an applicator attached to said second end of said post for delivering fluid material from the interior portion of said shell, and a slider device having a first end attached to said post and a second end accessible outside said shell, said second end of said slider device moveable along the outside of said shell between said closed end and said open end of said shell, whereby manipulation of said second end of said slider device between said closed end and said open end of said shell is operative for displacement of said applicator from a first position within said interior portion of said shell to a second position exterior of said shell upon passage through said open end of said shell.

2. The dispenser of claim 1, wherein said sleeve has an interior diameter and said post has an exterior diameter, wherein said interior diameter and said exterior diameter are dimensioned to provide said post with a sliding fit within said sleeve when said applicator is displaced between said first and second positions.

3. The dispenser of claim 1, further including a seal member at said second open end of said sleeve having a portion in sliding contact with the exterior surface of said post.

4. The dispenser of claim 1, further including a wiper within said interior portion of said shell adjacent said open end thereof, said wiper having an opening in communication with said open end of said shell to allow passage of said applicator therethrough, said opening dimensioned to provide a sliding fit with the exterior surface of said post.

5. The dispenser of claim 1, further including a quantity of cosmetic material in said interior portion of said shell.

6. The dispenser of claim 5, wherein said cosmetic material comprises mascara.

7. The dispenser of claim 1, wherein said shell has a cylindrical cross-section along substantially its length.

8. The dispenser of claim 1, further including a guide within said shell adjacent said closed end thereof, said guide having a first portion cooperating with a portion of the closed end of said shell to provide a first passageway through which said slider device extends.

9. The dispenser of claim 8, wherein a second portion of said guide is received within said first open end of said sleeve to provide a second passageway through which said slider device extends into said sleeve.

10. The dispenser of claim 8, wherein said closed end of said shell is formed by a plug, said plug having a portion supporting said guide within said shell.

11. The dispenser of claim 1, wherein said shell has a longitudinal axis, said second end of said slider device moveable along said longitudinal axis.

12. The dispenser of claim 1, wherein said sleeve is concentrically arranged within said shell forming an annular space therebetween for receiving said fluid material.

13. A dispenser for fluid material, said dispenser comprising an elongated shell having a closed end and an open end providing an interior portion therebetween for receiving a quantity of fluid material, an elongated sleeve within said interior portion having a first open end supported within said shell and a second open-end opposing said open end of said shell, a post slidably received with said sleeve having a first end opposing said closed end of said shell and a second end opposing said open end of said shell, an applicator attached to said second end of said post for delivering fluid material from the interior portion of said shell, a slider device having a first end attached to said post and a second end accessible outside said shell, and a piston positioned within said interior portion of said shell movable along said sleeve from a position adjacent said first open end of said sleeve to a position adjacent said second open end of said sleeve, whereby manipulation of said second end of said slider device between a first and second position is operative for displacement of said applicator from a first position within said interior portion of said shell to a second position exterior of said shell upon passage through said open end of said shell.

14. A dispenser for cosmetic material, said dispenser comprising an elongated outer shell concentrically arranged about an inner elongated sleeve defining therebetween a reservoir for receiving a quantity of cosmetic material, an elongated post slidably received within said sleeve, a cosmetic applicator arranged within said reservoir and attached to one end of said post, a device having a first portion attached to said post and a second portion accessible from outside said shell, said device moveable by manipulation of said second portion whereby said applicator is displaced from within said reservoir to a location outside said shell for application of cosmetic material retained on said applicator, and a closure member at one end of said shell having an opening extending therethrough, said closure member moveable between an open position wherein said opening is in communication with said reservoir and a closed position to prevent passage of said applicator therethrough.

15. The dispenser of claim 14, wherein said device is releasably attachable to said closure member to effect movement of said closure member between said open and closed positions.

16. A dispenser for fluid material, said dispenser comprising an elongated shell having a closed end and an open end providing an interior portion therebetween for receiving a quantity of fluid material, an elongated sleeve within said interior portion having a first open end supported within said shell and a second open-end opposing said open end of said shell, a post slidably received with said sleeve having a first end opposing said closed end of said shell and a second end opposing said open end of said shell, an applicator attached to said second end of said post for delivering fluid material from the interior portion of said shell, a slider device having a first end attached to said post and a second end accessible outside said shell, a wiper within said interior portion of said shell adjacent said open end thereof, said wiper having a seat defining an opening in communication with said open end of said shell to allow passage of said applicator therethrough, and a closure member within said shell outwardly of said wiper, said closure member having a portion thereof in engagement with said seat to provide a seal therebetween, said closure member moveable between an open position wherein said opening is in alignment with said open end of said shell and a closed position wherein said opening is out of alignment with said open end of said shell to prevent passage of said applicator therethrough, whereby manipulation of said second end of said slider device between a first and second position is operative for displacement of said applicator from a first position within said interior portion of said shell to a second position exterior of said shell upon passage through said open end of said shell.

17. A dispenser for cosmetic material, said dispenser comprising an elongated otter shell concentrically arranged about an inner elongated sleeve defining therebetween a reservoir for receiving a quantity of cosmetic material, said shell including a concentrically arranged sleeve member attached to said shell, said sleeve member having an interior surface defining a portion of said reservoir, an elongated post slidably received within said sleeve, a cosmetic applicator arranged within said reservoir and attached to one end of said post, and a device having a first portion attached to said post and a second portion accessible from outside said shell, said device moveable by manipulation of said second portion whereby said applicator is displaced from within said reservoir to a location outside said shell for application of cosmetic material retained on said applicator.

18. A dispenser for cosmetic material, said dispenser comprising an elongated outer shell concentrically arranged about an inner elongated sleeve defining therebetween a reservoir for receiving a quantity of cosmetic material, an elongated post slidably received within said sleeve, a cosmetic applicator arranged within said reservoir and attached to one end of said post, a device having a first portion attached to said post and a second portion accessible from outside said shell, said device moveable by manipulation of said second portion whereby said applicator is displaced from within said reservoir to a location outside said shell for application of cosmetic material retained on said applicator, and- a flexible band extending between said post and said second portion, said second portion extending outwardly through an elongated opening within said shell.

19. A dispenser for cosmetic material, said dispenser comprising an elongated outer shell concentrically arranged about an inner elongated sleeve defining therebetween a reservoir for receiving a quantity of cosmetic material, an elongated post slidably received within said sleeve, a cosmetic applicator arranged within said reservoir and attached to one end of said post, a device having a first portion attached to said post and a second portion accessible from outside said shell, said device moveable by manipulation of said second portion whereby said applicator is displaced from within said reservoir to a location outside said shell for application of cosmetic material retained on said applicator, a wiper within said shell at an end of said reservoir, said wiper having a seat defining an opening in communication with said reservoir to allow passage of said applicator therethrough, and a closure member within said shell outwardly of said wiper, said closure member having a portion thereof in engagement with said seat to provide a seal therebetween, said closure member moveable between an open position wherein said opening is in alignment with said open end of said shell and a closed position wherein said opening is out of alignment with said open end of said shell to prevent passage of said applicator therethrough.

20. A dispenser for cosmetic material, said dispenser comprising an elongated outer shell having a length and concentrically arranged about an inner elongated sleeve defining therebetween a reservoir for receiving a quantity of cosmetic material, an elongated post slidably received within said sleeve, a cosmetic applicator arranged within said reservoir and attached to one end of said post, and a device having a first portion attached to said post and a second portion accessible from outside said shell, said second portion moveable along a portion of the length of said shell, said device moveable by manipulation of said second portion along the length of said shell whereby said applicator is displaced from within said reservoir to a location outside said shell for application of cosmetic material retained on-said applicator.

21. The dispenser of claim 20, wherein said cosmetic material comprises mascara.

22. The dispenser of claim 20, wherein said post is dimensioned to provide a sliding fit within said sleeve.

23. The dispenser of claim 20, further including a seal member having a portion in sliding contact with the exterior surface of said post.

24. The dispenser of claim 20, further including a wiper within said reservoir, said wiper having an opening to allow passage of said applicator therethrough and to provide a sliding fit with the exterior surface of said post.

25. The dispenser of claim 20, wherein said other shell has a longitudinal axis, said second portion moveable along said longitudinal axis.

26. The dispenser of claim 20, wherein said shell has a uniform cylindrical cross-section along substantially its length.

27. The dispenser of claim 20, wherein one end of said shell includes an external threaded portion, and a cap having an internal thread portion for mating with said threaded portion of said shell to preclude access to said reservoir.

28. The dispenser of claim 20, further including a wiper within said shell at an end of said reservoir, said wiper having a seat defining an opening in communication with said reservoir to allow passage of said applicator therethrough, and a closure member within said shell outwardly of said wiper, said closure member having a portion thereof in engagement with said seat to provide a seal therebetween, said closure member moveable between an open position wherein said opening is in alignment with said open end of said shell and a closed position wherein said opening is out of alignment with said open end of said shell to prevent passage of said applicator therethrough.

29. The dispenser of claim 20, further including a plug within said shell forming a closed end thereat.

30. The dispenser of claim 29, further including a guide within said shell adjacent said plug, said guide having a first portion cooperating with a portion of said plug to provide a first passageway through which said device extends.

31. The dispenser of claim 30, wherein a second portion of said guide cooperates with a portion of said sleeve to provide a second passageway through which said device extends into said sleeve for movement of said post.

32. A dispenser for cosmetic material, said dispenser comprising an elongated outer shell concentrically arranged about an inner elongated sleeve defining therebetween a reservoir for receiving a quantity of cosmetic material, an elongated post slidably received within said sleeve, a cosmetic applicator arranged within said reservoir and attached to one end of said post, a piston positioned within said reservoir movable along said sleeve, and a device having a first portion attached to said post and a second portion accessible from outside said shell, said device moveable by manipulation of said second portion whereby said applicator is displaced from within said reservoir to a location outside said shell for application of cosmetic material retained on said applicator.

33. The dispenser of claim 32, further including a spring within said shell in engagement with said piston for maintaining cosmetic material, when present in said reservoir, under a compressive force.

34. The dispenser of claim 33, wherein said spring is maintained under compression.

35. The dispenser of claim 33, wherein said spring is maintained under tension.

36. The dispenser of claim 35, wherein said spring is positioned about said sleeve within said reservoir.

37. The dispenser of claim 32, further including a first seal between said piston and said interior surface of said shell and a second seal between said piston and said exterior surface of said sleeve.

38. A dispenser for cosmetic material, said dispenser comprising an elongated cylindrical shell having a closed end and an open end defining therebetween a reservoir for receiving a quantity of cosmetic material, an elongated cylindrical sleeve concentrically arranged within said reservoir having a first open end and a spaced apart second open end opposing said open end of said shell, an elongated post slidably received within said sleeve having a first end opposing said closed end of said shell and a second end opposing said open end of said shell, a seal member at said open end of said sleeve having a portion in sliding contact with the exterior surface of said post, a wiper within said reservoir of said shell adjacent said open end thereof, said wiper having an opening in communication with said open end of said shell, an applicator attached to said second end of said post for delivering cosmetic material from said reservoir, a closure member within said shell outwardly of said open end thereof, said closure member having an opening extending therethrough for communicating with said reservoir, said closure member moveable between an open position wherein said opening is in alignment with said open end of said shell and a closed position wherein said opening is out of alignment with said open end of said shell to prevent passage of said applicator therethrough, a slider having a first end attached to said first end of said post and a second end accessible outside said shell, whereby manipulation of said slider between a first and second position is operative for displacement of said applicator from a first position within said reservoir to a second position exterior of said shell upon passage through said open end of said shell and said opening with said closure member, and means for maintaining said cosmetic material when present in said reservoir under a compressive force.

39. The dispenser of claim 38, further including a quantity of cosmetic material within said reservoir.

40. The dispenser of claim 39, wherein said cosmetic material comprises mascara.

41. The dispenser of claim 38, wherein said slider is releasably attachable to said closure member whereby manipulation of said slider between said first and second positions is operative for causing said closure member to move between said open and closed positions.

42. The dispenser of claim 38, wherein said means comprises a piston movably positioned within said reservoir along said sleeve, initially adjacent said first open end of said sleeve when said reservoir is filled with cosmetic material, and further including a spring engaging said piston whereby said cosmetic material when present in said reservoir is maintained under a compressive force.

43. The dispenser of claim 42, further including a first seal between said piston and the interior surface of said shell and a second seal between said piston and the exterior surface of aid sleeve.

44. The dispenser of claim 38, wherein said opening in said wiper is dimensioned to provide a sliding fit within the exterior surface of said post.

45. The dispenser of claim 44, herein said wiper creates a seal with the exterior surface of said post when said applicator is in said second position exterior of said shell.

46. The dispenser of claim 44, wherein said means comprises a piston movably positioned within said reservoir along said sleeve, initially adjacent said first open end of said sleeve when said reservoir is filled with cosmetic material, and further including a spring within said reservoir about said sleeve, said spring being maintained under tension whereby said cosmetic material when present in said reservoir is maintained under a compressive force.

47. The dispenser of claim 38, further including a wiper within said reservoir of said shell adjacent said open end thereof, said wiper having a seat defining an opening in communication with said open end of said shell to allow passage of said applicator therethrough, and a closure member within said shell outwardly of said wiper, said closure member having a portion thereof in engagement with said seat to provide a seal therebetween, said closure member moveable between an open position wherein said opening is in alignment with said open end of said shell and a closed position wherein said opening is out of alignment with said open end of said shell to prevent passage of said applicator therethrough.

48. The dispenser of claim 38, further including a guide within said shell adjacent said closed end thereof, said guide having a first portion cooperating with a portion of the closed end of said shell to provide a first passageway through which said slider device extends.

49. The dispenser of claim 48, wherein a second portion of said guide is received within said first open end of said sleeve to provide a second passageway through which said slider device extends into said sleeve.

50. The dispenser of claim 48, wherein said closed end of said shell is formed by a plug, said plug having a portion supporting said guide within said shell.

51. The dispenser of claim 50, wherein said plug is rotatable within said shell.

52. The dispenser of claim 48, further including a spring between said piston and a portion of said sleeve adjacent said second open end of said sleeve, whereby said fluid material when present in said interior portion of said shell is maintained under a compressive force.

53. The dispenser of claim 52, further including an annular opening formed between the exterior surface of said sleeve and the interior surface of said shell, said piston positioned within said annular opening.

54. The dispenser of claim 53, further including a first seal between said piston and said interior surface of said shell and a second seal between said piston and said exterior surface of said sleeve.

55. A dispenser for fluid material, said dispenser comprising an elongated shell having a closed end and an open end providing an interior portion therebetween for receiving a quantity of fluid material, said shell including a sleeve member having an interior surface defining said interior portion of said shell, an elongated sleeve within said interior portion having a first open end supported within said shell and a second open-end opposing said open end of said shell, a post slidably received with said sleeve having a first end opposing said closed end of said shell and a second end opposing said open end of said shell, an applicator attached to said second end of said post for delivering fluid material from the interior portion of said shell, and a slider device having a first end attached to said post and a second end accessible outside said shell, whereby manipulation of said second end of said slider device between a first and second position is operative for displacement of said applicator from a first position within said interior portion of said shell to a second position exterior of said shell upon passage through said open end of said shell.

56. The dispenser of claim 55, wherein a dispenser for fluid material, said dispenser comprising an elongated shell having a closed end and an open end providing an interior portion therebetween for receiving a quantity of fluid material, an elongated sleeve within said interior portion having a first open end supported within said shell and a second open-end opposing said open end of said shell, a post slidably received with said sleeve having a first end opposing said closed end of said shell and a second end opposing said open end of said shell, an applicator attached to said second end of said post for delivering fluid material from the interior portion of said shell, a slider device having a first end attached to said post and a second end accessible outside said shell, and a closure member within said shell outwardly of said open end thereof, said closure member having an opening extending therethrough for communicating with said interior portion of said shell, said closure member moveable between an open position wherein said opening is in alignment with said open end of said shell and a closed position wherein said opening is out of alignment with said open end of said shell to prevent passage of said applicator therethrough, whereby manipulation of said second end of said slider device between a first and second position is operative for displacement of said applicator from a first position within said interior portion of said shell to a second position exterior of said shell upon passage through said open end of said shell.

57. The dispenser of claim 56, wherein said slider device is releasably attachable to said closure member whereby manipulation of said slider device between said first and second positions is operative for causing said closure member to move between said open and closed positions.

58. The dispenser of claim 55, wherein said slider device includes an elongated flexible member having a first end attached to said first end of said post and extending along the exterior surface of said sleeve member to a second end protruding from said shell through an elongated slot within said shell.

* * * * *

UNITED STATES PATENT AND TRADEMARK OFFICE

CERTIFICATE OF CORRECTION

PATENT NO. : 6,371,129 B1 
DATED : April 16, 2002
INVENTOR(S) : Robert Nathan Le Bras-Brown, Manhar K. Patel, Leo Clifford Pires, Albert J. Stiso, Jr. and James Joseph Thalheimer It is certified that error appears in the above-identified patent and that said Letters Patent is hereby corrected as shown below:

Column 1,
Line 23, "resupplyed" should read -- resupplied --.

Column 11,
Line 10, "are" should read -- is --.

Column 15,
Line 2, "otter" should read -- outer --.
Line 27, cancel the hyphen after the word "and."
Line 67, "on-said" should read -- on said --.

Column 18,
Line 32, "48" should read -- 13 --.

Signed and Sealed this

Fifth Day of November, 2002

*Attest:*

*Attesting Officer*

JAMES E. ROGAN
*Director of the United States Patent and Trademark Office*